US009892712B2

(12) United States Patent
Chandra et al.

(10) Patent No.: US 9,892,712 B2
(45) Date of Patent: Feb. 13, 2018

(54) FILTERING HOT PLUG DETECT SIGNALS

(71) Applicant: Intel Corporation, Santa Clara, CA (US)

(72) Inventors: Saran Chandra, Bangalore (IN); Vandana Kannan, Bangalore (IN); Ganesh Ram Sumaithangi Thattai, Bangalore (IN)

(73) Assignee: Intel Corporation, Santa Clara, CA (US)

( * ) Notice: Subject to any disclaimer, the term of this patent is extended or adjusted under 35 U.S.C. 154(b) by 477 days.

(21) Appl. No.: 14/563,834

(22) Filed: Dec. 8, 2014

(65) Prior Publication Data

US 2016/0163281 A1 Jun. 9, 2016

(51) Int. Cl.
*G09G 5/00* (2006.01)

(52) U.S. Cl.
CPC ..... *G09G 5/006* (2013.01); *G09G 2370/047* (2013.01); *G09G 2370/22* (2013.01)

(58) Field of Classification Search
CPC ..... G09G 5/006; G09G 2370/047; G09G 2370/22
See application file for complete search history.

(56) References Cited

U.S. PATENT DOCUMENTS

2008/0056424 A1* 3/2008 Chang ..... H04L 7/0083 375/371
2011/0025696 A1* 2/2011 Wyatt ..... G09G 5/363 345/502
2011/0302340 A1* 12/2011 Kim ..... G09G 3/2096 710/58
2014/0092107 A1 4/2014 Ferry et al.
2014/0113547 A1 4/2014 Kwak et al.
2014/0213327 A1 7/2014 Johnson et al.

FOREIGN PATENT DOCUMENTS

CN 102455886 A 5/2012
CN 103546741 A 1/2014
WO 2008027760 A1 3/2008

OTHER PUBLICATIONS

International Search Report, PCT No. PCT/US2015/053659, dated Jan. 22, 2016, 4 pages.
Taiwan Search Report, Taiwan Application No. 104136323, dated Aug. 16, 2016, 2 pages.

* cited by examiner

*Primary Examiner* — Eric Oberly
(74) *Attorney, Agent, or Firm* — International IP Law Group, P.L.L.C.

(57) ABSTRACT

Techniques related to filtering hot plug signals are described herein. The techniques include receiving a first hot plug detect (HPD) signals and a second HPD signal from an external display device. A time period between receiving the first and second HPD signals is determined, and the first and second HPD signals are filtered based on the determined time period.

25 Claims, 5 Drawing Sheets

200

300

400

FILTERING HOT PLUG DETECT SIGNALS

TECHNICAL FIELD

This disclosure relates generally to filtering of hot plug detect signals. More specifically, the techniques described herein include filtering hot plug detect signals provided from an external display device.

BACKGROUND ART

In computer systems, an external display device may be used to display images from a computing device at the external display device. In some cases, an external display device may operate in an auto detection mode wherein the external display device may periodically trigger a hot plug detect (HPD) signal. The HPD signal that might be issued by the external display device may be serviced by software of the computing device, such as operating system software of the computing device. An HPD signal may include a pair of HPD interrupt signals including an unplug and plug pair. Such pairs of HPD signals can occur repeatedly as long as the external display device is connected to the computing device. In some cases, issuing a HPD signal may trigger a disconnect of the external display device from the computing system that is unintended, or otherwise not genuine.

For example, an external display device may be configured with multiple interfaces. If a display configuration is configured to display images at an internal display, an external display device connected via a High Definition Multimedia Interface (HDMI) port may be turned off. In some cases, the auto detection mode of the external display device may begin to check each of the multiple interfaces to find an active signal input. While the external display device is checking each of the multiple interfaces, an HPD signal may be issued by the external display device to the computing device to be serviced by the operating system. In some cases, the HPD interrupt signals may create a distracting viewing environment for a user of the computing system as the signals are serviced by the operating system.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DETAILED DESCRIPTION

The subject matter disclosed herein relates to techniques for filtering hot plug detect (HPD) signals. As discussed above, in some cases an external display device may issue HPD signals that may interrupt a viewing experience. For example, if a display configuration of a computing device is set to display images on an internal display device, a connected external display device may issue HPD signals as it cycles through multiple interface protocols available to the external display device. HPD signals that are not filtered may be provided to an operating system of the computing device and may result in a reconfiguration of a display which is not active. In some cases, reconfiguration of the display which is not active may result in activating the external display, and switching back to older configuration will again result in the same behavior, thus repeating this in a cycle.

In some cases, the HPD signals are issued by an auto detect feature of the external computing device. The techniques described herein include filtering HPD signals based on a time delay between received HPD signals that is characteristic of the auto detect feature rather than a genuine hot plug or unplug event. For example, an auto detect feature may issue HPD signals in pairs including a hot unplug signal and a hot plug signal. A time delay between issuing the hot unplug and hot plug signals may be specific to a given external display device. However, in many cases, the time delay between HPD signal pairs for an external display device is short when compared to a hot unplug and plug signal pair that may occur when a manual unplug and plug event is performed. In this scenario, the manual hot unplug and plug events may be considered genuine. Therefore, in this case, the filtering techniques described herein may filter HPD signals received that are at or below a predetermined threshold associated with the auto detect feature, while preserving transmission of genuine hot plug and unplug events that exceed the threshold.

Figure 1:
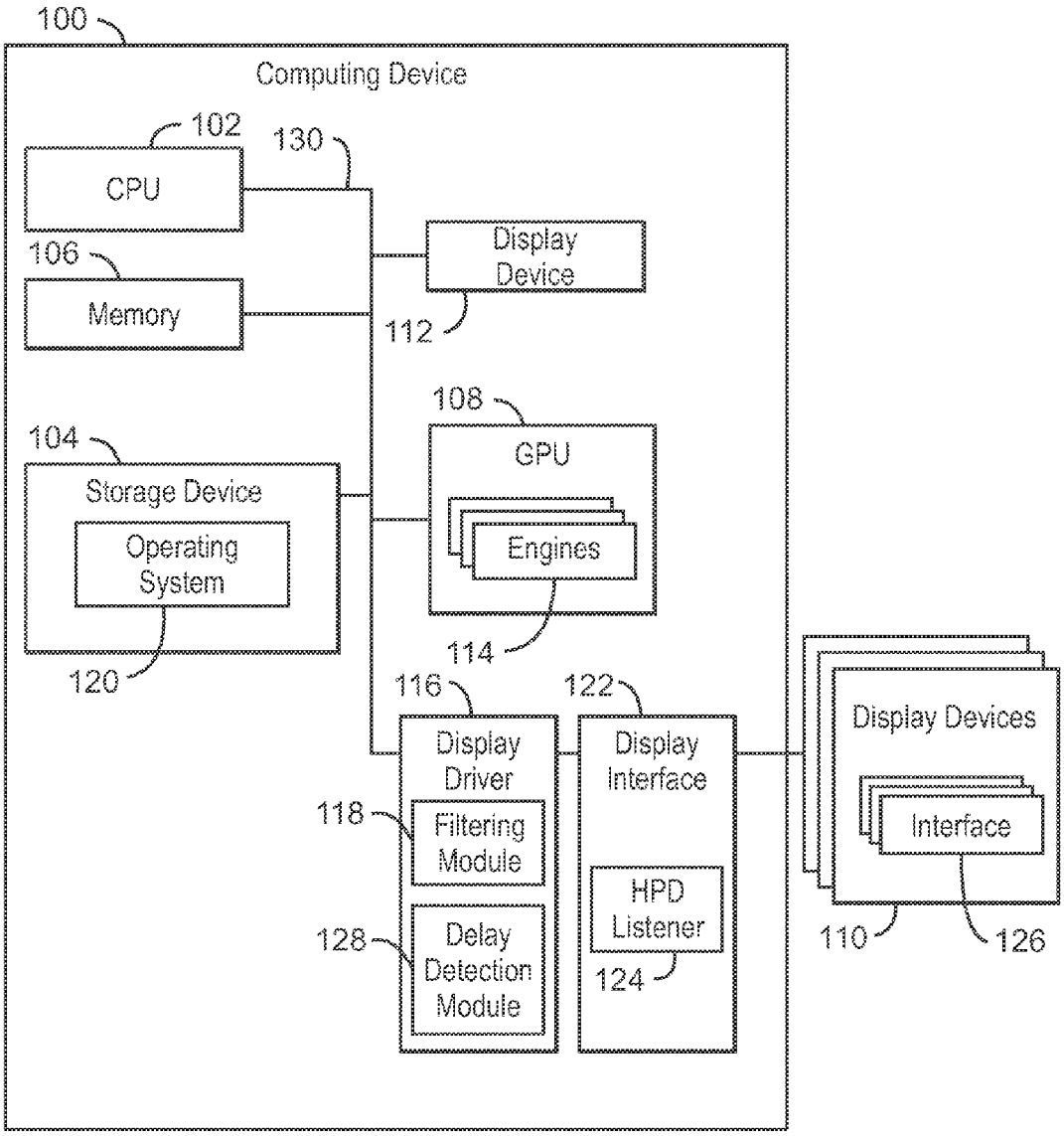
FIG. 1 is a block diagram illustrating a computing device configured to filter hot plug detect (HPD) signals.

FIG. 1 is a block diagram illustrating a computing device configured to filter HPD signals. The computing device 100 may be, for example, a laptop computer, desktop computer, ultrabook, tablet computer, mobile device, or server, among others. The computing device 100 may include a central processing unit (CPU) 102 that is configured to execute stored instructions, as well as a storage device 104 including a non-transitory computer-readable medium, and a memory device 106.

The computing device 100 may also include a graphics processing unit (GPU) 108. In embodiments, the GPU 108 is embedded in the CPU 102. The GPU 108 may include a cache, and can be configured to perform any number of graphics operations within the computing device 100. For example, the GPU 108 may be configured to render or manipulate graphics images, graphics frames, videos, or the like, to be displayed to a user of the computing device 100 at one or more display devices including external display devices 110, an internal display device 112, or any combination thereof. The GPU 108 includes plurality of engines 114.

In some cases, the engines 114 may be configured to perform filtering as directed by instructions of display driver 116 including a filtering module 118. In some cases, the filtering module 118 may be implemented as logic, at least partially comprising hardware logic. In other cases, the filtering module 118 may be implemented as a portion of software instructions of the display driver 116. The display driver 116 may be implemented by operations of an operating system 120. Software instructions may be configured to be carried out by the engines 114 of the GPU 108, by the CPU 102, or any other suitable controller. In yet other cases, the filtering module 118 may be implemented as electronic logic, at least partially comprising hardware logic, to be carried out by electronic circuitry, circuitry to be carried out by an integrated circuit, and the like. The filtering module 118 may be configured to operate independently, in parallel, distributed, or as a part of a broader process. In yet other cases, the filtering module 118 may be implemented as a combination of software, firmware, hardware logic, and the like.

A display interface 122 may include a HPD Listener 124 configured to receive HPD signals. For example, the HPD Listener 124 may be configured to receive HPD signal pairs including a first HPD signal followed by a second HPD signal. A delay detection module 128 may be configured to determine a time delay between receiving the first HPD signal and receiving the second HPD signal. The delay detection module 128 may be a component of the display driver 116. However, the delay detection module 128 need not be a component of the display driver 116, and may be implemented as firmware, hardware logic with time delay as a configurable input, or any combination thereof.

As discussed above, if a display configuration is set to display images at the internal display device 112, external display devices, such as the external display devices 110, may include multiple interfaces that may be checked for an active signal. Checking for an active signal may generate the first and second HPD signals, such as hot unplug and plug event signal pairs. In some cases, one or more of the external display devices 110 may be configured to continuously issue HPD signals in between an unplug and plug event signal pair. In either case, the filtering module 118 is configured to filter the HPD signals received based on the time delay between receiving the first HPD signal and the second HPD signal.

As discussed above, a manual user-driven hot plug or unplug of a cable connecting the computing device 100 to one or more of the external display devices may be referred to herein as a genuine, or valid, plug or unplug event. As a manual user driven hot plug or hot unplug event may require a time delay that is longer than the time delay between HPD signal pairs issued by one or more of the external display devices 110, the filtering module 118 may suppress HPD signal pairs having a time delay below a predetermined threshold.

In some cases, the predetermined threshold may be determined by the delay detection module 128. The predetermined threshold may be specific to any given external display device, such as one of the external display devices 110. Therefore, in some cases, the delay detection module 128 may receive extended display identification data (EDID) provided from any given external display device 110. The EDID data may indicate a time delay between HPD signals, and the predetermined threshold may therefore be based on the time delay indicated in the EDID data. In other cases, the display detection module 128 may receive time delay information available to the operating system 120. In this scenario, the operating system 120 may refer to specification data for a given external display device 110, and the predetermined threshold may be based on HPD time delays indicated in the specification data. In yet other embodiments, the time delay information may be received from any combination of the techniques described above.

The memory device 104 can include random access memory (RAM), read only memory (ROM), flash memory, or any other suitable memory systems. For example, the memory device 106 may include dynamic random access memory (DRAM). The memory device 106 can include random access memory (RAM) (e.g., static random access memory (SRAM), dynamic random access memory (DRAM), zero capacitor RAM, Silicon-Oxide-Nitride-Oxide-Silicon SONOS, embedded DRAM, extended data out RAM, double data rate (DDR) RAM, resistive random access memory (RRAM), parameter random access memory (PRAM), etc.), read only memory (ROM) (e.g., Mask ROM, programmable read only memory (PROM), erasable programmable read only memory (EPROM), electrically erasable programmable read only memory (EEPROM), etc.), flash memory, or any other suitable memory systems.

The CPU 102 may be a main processor that is adapted to execute the stored instructions. The CPU 102 may be a single core processor, a multi-core processor, a computing cluster, or any number of other configurations. The CPU 102 may be implemented as Complex Instruction Set Computer (CISC) or Reduced Instruction Set Computer (RISC) processors, x86 Instruction set compatible processors, multi-core, or any other microprocessor or central processing unit (CPU). The CPU 102 may be connected through a system bus 130 (e.g., Peripheral Component Interconnect (PCI), Industry Standard Architecture (ISA), PCI-Express, HyperTransport®, NuBus, etc.) to components including the memory 106 and the storage device 104. The CPU 102 may also be linked through the bus 130 to the display driver 116 and the display interface 122 configured to connect the computing device 100 to external display devices 110 via a digital display interface. The external display devices 110 may include a computer monitor, television, or projector, among others, that are externally connected to the computing device 100.

In some cases, the computing device 100 may be a mobile computing device. In some cases, the external display devices 110 may be mobile external display devices to a mobile computing device.

The block diagram of FIG. 1 is not intended to indicate that the computing device 100 is to include all of the components shown in FIG. 1. Further, the computing device 100 may include any number of additional components not shown in FIG. 1, depending on the details of the specific implementation.

Figure 2:
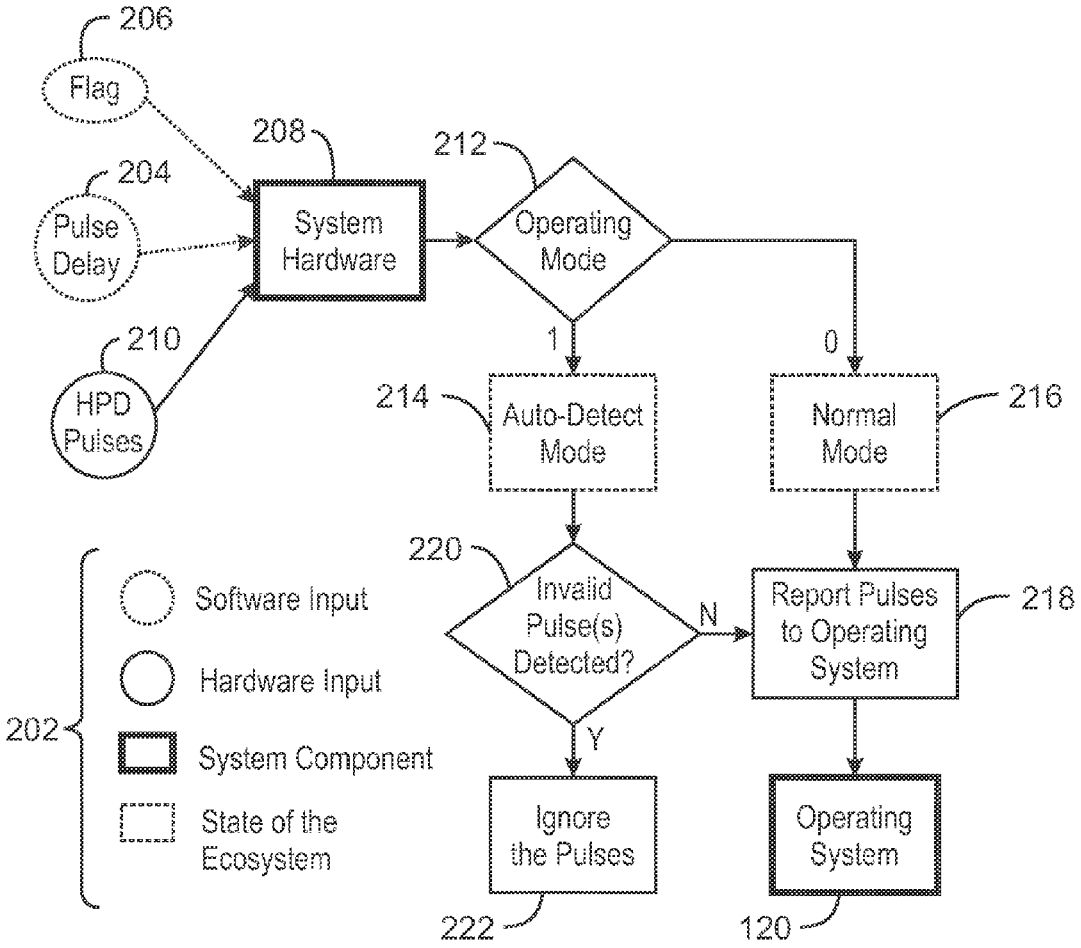
FIG. 2 is system diagram illustrating a process flow of filtering HPD signals.

FIG. 2 is system diagram illustrating a process flow of filtering HPD signals. The system diagram 200 includes software inputs, hardware inputs, system components, and system states as indicated at 202. Software inputs may include pulse delay information 204 and a flag 206. The pulse delay information 204 may be the predetermined time delay associated with a specific external display device, such as one or more of the external display devices 110 of FIG. 1. The flag 206 may be a configurable feature of the techniques described herein. For example, the flag 206 may be enabled by a user via an operating system, such as the operating system 120 of the computing device 100 of FIG. 1, in a display configuration menu. In some cases, the flag may be enabled when specific types of external display devices 110 having an auto-detect feature are connected to the computing device 100. In either case, system hardware 208 may receive flags 206 indicating the filtering is enabled, pulse delay information 204, as well as hardware input including the HPD pulses 210. The system hardware 208 may include any combination of the components of the computing device 100 of FIG. 1. At 212, an operating mode may be determined. The operating mode may initiated by either a plug event, indicated by "1," or an unplug event, indicated by "0," in FIG. 2.

A plug event may cause the system to enter auto-detect mode 214 in which filtering is enabled, while an unplug event may cause the system to enter a normal mode 216 in which filtering is disabled. Therefore, in some cases, filtering may only be implemented after a hot plug signal is received. In the normal mode, HPD pulses are reported 218 to the operating system 120. In auto-detect mode, the system may filter HPD pulses generated via an auto-detect feature of a connected external display device. As illustrated in FIG. 2, received HPD pulses may be determined to be genuine, or non-genuine, as indicated at 220. If the HPD pulses are not genuine, they are ignored at 222. If the HPD pulses are genuine, they may be reported 218 to the operating system 120.

Figure 3:
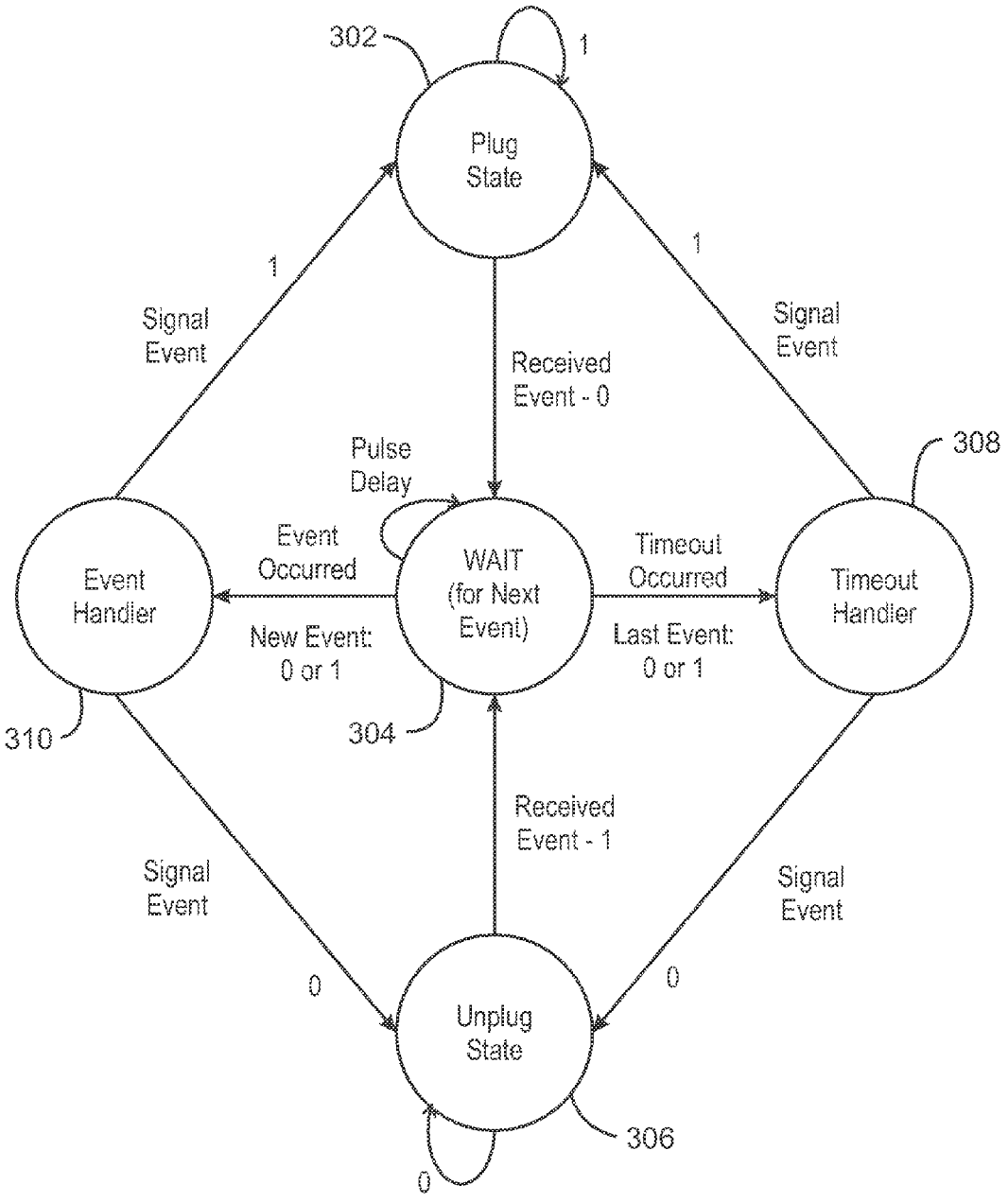
FIG. 3 is a state diagram illustrating state changes during HPD filtering.

FIG. 3 is a state diagram illustrating state changes during HPD filtering. Similar to FIG. 2, a "1" may indicate a plug event, and a "0" may indicate an unplug event. From a plug state indicated at 302, an unplug event may be received, wherein the state of a system 300 may proceed to wait for the next event, as indicated at 304. From an unplug state indicated at 306, a plug event may be received, wherein the state of the system may proceed to wait for the next event 304 as well. In some cases, the system 300 may wait for an extended period of time without receiving a subsequent event, in which case, the system would proceed to a timeout handler state as indicated at 308. However, if a new event occurs, the system 300 will process to an event handler state 310. The event handler state 310 may be the state in which the filtering discussed above in regard to FIG. 1 and FIG. 2 is performed. Subsequent events may be change the state of the system 300, but if non-genuine HPD signals are received, the HPD signals may be ignored.

Figure 4:
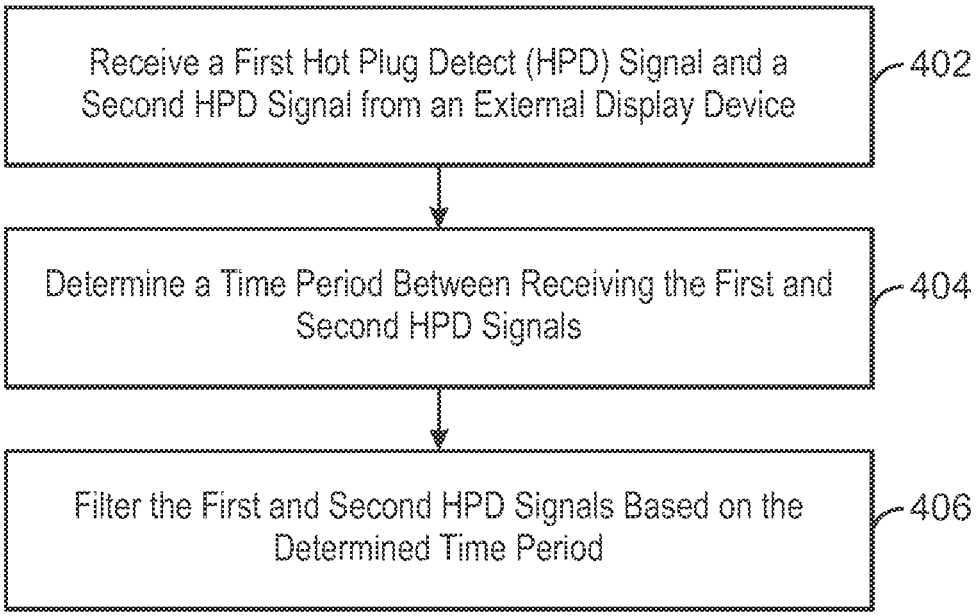
FIG. 4 is a block diagram illustrating a method for filtering HPD signals.

FIG. 4 is a block diagram illustrating a method for filtering HPD signals. A first HPD signal and a second HPD signal are received at block 402. The time period between receiving the first and second HPD signals may be determined at block 404. Filtering may be performed at block 406. The filtering at block 406 may be based on the determined time period.

Filtering may include comparing the determined time period to a predetermined time delay. As discussed above, the predetermined time delay be determined based on a specification for a given external display device, through EDID data provided from the external display device, or any combination thereof. The determined time period between HPD signals may be compared to the predetermined time delay and, if the determined time exceeds the predetermined time delay, the HPD signals may be associated with a valid hot plug or unplug event. If the determined time does not exceed the predetermined time delay, the method 400 may include suppressing reporting of the first and second HPD signals to an operating system of a computing device to which the external display device is connected.

Figure 5:
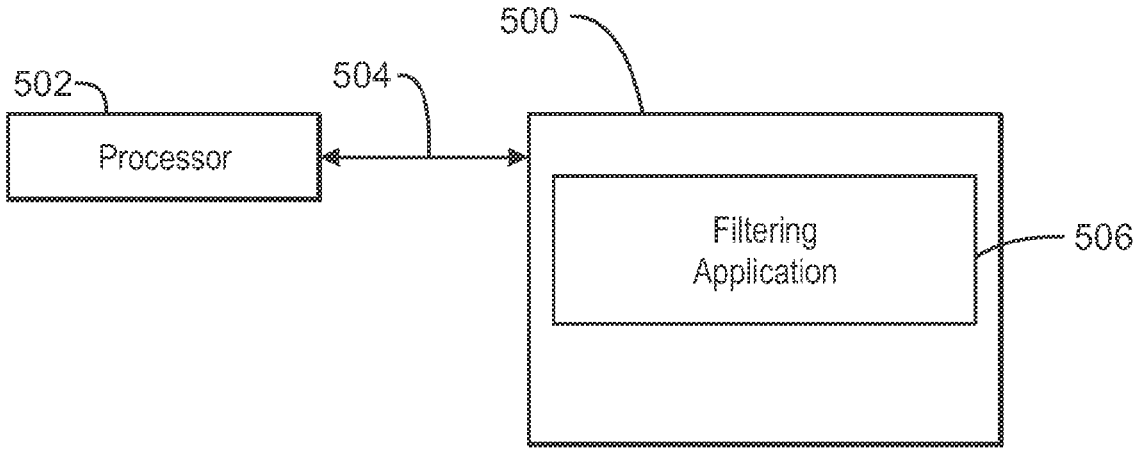
FIG. 5 is a block diagram depicting an example of a computer-readable medium configured to implement HPD signal filtering.

FIG. 5 is a block diagram depicting an example of a computer-readable medium configured to implement HPD signal filtering. The computer-readable medium 500 may be accessed by a processor 502 over a computer bus 504. In some examples, the computer-readable medium 500 may be a non-transitory computer-readable medium. In some examples, the computer-readable medium may be a storage medium. However, in any case, the computer-readable medium does not include transitory media such as carrier waves, signals, and the like. Furthermore, the computer-readable medium 500 may include computer-executable instructions to direct the processor 502 to perform the steps of the current method.

The various software components discussed herein may be stored on the tangible, non-transitory, computer-readable medium 500, as indicated in FIG. 5. For example, a filtering application 506 may be configured to receive a first hot plug detect (HPD) signal and a second HPD signal from an external display device, and determine a time period between receiving the first and second HPD signals. The filtering application 506 may also be configured to filter the first and second HPD signals based on the determined time period.

Examples may include subject matter such as a method, means for performing acts of the method, at least one machine-readable medium including instructions that, when performed by a machine cause the machine to performs acts of the method. It is to be understood that specifics in the aforementioned examples may be used anywhere in one or more embodiments. For instance, all optional features of the computing device described above may also be implemented with respect to either of the methods described herein or a computer-readable medium. Furthermore, although flow diagrams and/or state diagrams may have been used herein to describe embodiments, the present techniques are not limited to those diagrams or to corresponding descriptions herein. For example, flow need not move through each illustrated box or state or in exactly the same order as illustrated and described herein.

Example 1 includes an apparatus for filtering hot plug signals. The apparatus includes a hot plug detect (HPD) listener to receive a first hot plug detect (HPD) signal and a second HPD signal from an external display device. The apparatus further includes a delay detection module to determine a time period between receiving the first and second HPD signals. The apparatus further includes a filtering module to filter the first and second HPD signals based on the determined time period.

In example 1, the filtering module is to compare the determined time period to a predetermined time delay. The predetermined time delay is associated with an auto detect feature of the external display device in some cases. The delay detection module is to determine the predetermined time delay of the external display device. In some cases, the delay detection module is to determine the predetermined time delay based on specification data for the external display device in an operating system of a computing device to which the external display device is communicatively coupled. In some cases, the delay detection module is to determine the predetermined time period based on extended display identification data (EDID) provided from the external display device.

The external display device includes a plurality of display interface protocol capabilities. The filtering module may be enabled by a user via an operating system of a computing device to which the external display device is communicatively coupled. The filtering module may be further configured to compare the determined time period to a predetermined time delay, and associate the HPD signals with a valid hot plug event if the determined time period exceeds the predetermined time delay. In some cases, the filtering module is further to suppress reporting of the first and second HPD signals to an operating system of a computing device if the determined time period does not exceed the predetermined time delay.

Example 2 includes a method for filtering hot plug signals. The method includes receiving a first hot plug detect (HPD) signal and a second HPD signal from an external display device, and determining a time period between receiving the first and second HPD signals. The method further includes filtering the first and second HPD signals based on the determined time period.

In some cases, the filtering includes comparing the determined time period to a predetermined time delay. The predetermined time delay may be associated with an auto detect feature of the external display device. The method may further include determining the predetermined time delay of the external display device based on specification data for the external display device in an operating system of a computing device to which the external display device is communicatively coupled. In some cases, the method may further include determining the predetermined time delay of the external display device based on extended display identification data (EDID) provided from the external display device.

The external display device includes a plurality of display interface protocol capabilities. The filtering may be enabled by a user via an operating system of a computing device to which the external display device is communicatively coupled. The filtering may be further configured to compare the determined time period to a predetermined time delay, and associate the HPD signals with a valid hot plug event if the determined time period exceeds the predetermined time delay. In some cases, the filtering is further to suppress reporting of the first and second HPD signals to an operating system of a computing device if the determined time period does not exceed the predetermined time delay.

Example 3 is a computer-readable storage medium. The computer-readable storage medium includes code to direct a processor to receive a first hot plug detect (HPD) signal and a second HPD signal from an external display device, determine a time period between receiving the first and second HPD signals, and filter the first and second HPD signals based on the determined time period.

In example 3, the filtering is to compare the determined time period to a predetermined time delay. The predetermined time delay is associated with an auto detect feature of the external display device in some cases. The delay detection is to determine the predetermined time delay of the external display device. In some cases, the delay detection is to determine the predetermined time delay based on specification data for the external display device in an operating system of a computing device to which the external display device is communicatively coupled. In some cases, the delay detection is to determine the predetermined time period based on extended display identification data (EDID) provided from the external display device.

The external display device includes a plurality of display interface protocol capabilities. The filtering may be enabled by a user via an operating system of a computing device to which the external display device is communicatively coupled. The filtering may be further configured to compare the determined time period to a predetermined time delay, and associate the HPD signals with a valid hot plug event if the determined time period exceeds the predetermined time delay. In some cases, the filtering is further to suppress reporting of the first and second HPD signals to an operating system of a computing device if the determined time period does not exceed the predetermined time delay.

Example 4 includes an apparatus for filtering hot plug signals. The apparatus includes a hot plug detect (HPD) listening means to receive a first hot plug detect (HPD) signal and a second HPD signal from an external display device. The apparatus further includes a delay detection means to determine a time period between receiving the first and second HPD signals. The apparatus further includes a filtering means to filter the first and second HPD signals based on the determined time period.

In example 4, the filtering means is to compare the determined time period to a predetermined time delay. The predetermined time delay is associated with an auto detect feature of the external display device in some cases. The delay detection means is to determine the predetermined time delay of the external display device. In some cases, the delay detection means is to determine the predetermined time delay based on specification data for the external display device in an operating system of a computing device to which the external display device is communicatively coupled. In some cases, the delay detection means is to determine the predetermined time period based on extended display identification data (EDID) provided from the external display device.

The external display device includes a plurality of display interface protocol capabilities. The filtering means may be enabled by a user via an operating system of a computing device to which the external display device is communicatively coupled. The filtering means may be further configured to compare the determined time period to a predetermined time delay, and associate the HPD signals with a valid hot plug event if the determined time period exceeds the predetermined time delay. In some cases, the filtering means is further to suppress reporting of the first and second HPD signals to an operating system of a computing device if the determined time period does not exceed the predetermined time delay.

The means for each of filtering, listening, and detection may be implemented as one or more of logic, hardware logic, electronic logic, software, firmware and the like. In some cases, the means for each of filtering, listening, and detection may be combined as a broader process.

Example 5 includes system for filtering hot plug signals. The system includes an external display device and a host device. The host device includes hot plug detect (HPD) listener to receive a first hot plug detect (HPD) signal and a second HPD signal from an external display device. The host device further includes a delay detection module to determine a time period between receiving the first and second HPD signals. The host device further includes a filtering module to filter the first and second HPD signals based on the determined time period.

In Example 5, the filtering module is to compare the determined time period to a predetermined time delay. The predetermined time delay is associated with an auto detect feature of the external display device in some cases. The delay detection module is to determine the predetermined time delay of the external display device. In some cases, the delay detection module is to determine the predetermined time delay based on specification data for the external display device in an operating system of a computing device to which the external display device is communicatively coupled. In some cases, the delay detection module is to determine the predetermined time period based on extended display identification data (EDID) provided from the external display device.

The external display device includes a plurality of display interface protocol capabilities. The filtering module may be enabled by a user via an operating system of a computing device to which the external display device is communicatively coupled. The filtering module may be further configured to compare the determined time period to a predetermined time delay, and associate the HPD signals with a valid hot plug event if the determined time period exceeds the predetermined time delay. In some cases, the filtering module is further to suppress reporting of the first and second HPD signals to an operating system of a computing device if the determined time period does not exceed the predetermined time delay.

In the above description and the following claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices.

An embodiment is an implementation or example. Reference in the present specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the present techniques. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An apparatus for filtering hot plug signals, comprising:
- a hot plug detect (HPD) listener to receive a first hot plug detect signal and a second HPD signal from an external display device;
- a delay detection module to determine a time period between receiving the first and second HPD signals; and
- a filtering module to filter the first and second HPD signals based on the determined time period.

2. The apparatus of claim 1, wherein the filtering module is to compare the determined time period to a predetermined time delay.

3. The apparatus of claim 2, wherein the predetermined time delay is associated with an auto detect feature of the external display device.

4. The apparatus of claim 2, wherein the delay detection module is to determine the predetermined time delay of the external display device.

5. The apparatus of claim 4, wherein the delay detection module is to determine the predetermined time delay based on specification data for the external display device in an operating system of a computing device to which the external display device is communicatively coupled.

6. The apparatus of claim 4, wherein the delay detection module is to determine the predetermined time period based on extended display identification data (EDID) provided from the external display device.

7. The apparatus of claim 1, wherein the external display device comprises a plurality of display interface protocol capabilities.

8. The apparatus of claim 1, wherein the filtering module is to be enabled by a user via an operating system of a computing device to which the external display device is communicatively coupled.

9. The apparatus of claim 1, wherein the filtering module is to:
- compare the determined time period to a predetermined time delay; and
- associate the HPD signals with a valid hot plug event if the determined time period exceeds the predetermined time delay.

10. The apparatus of claim 9, wherein the filtering module is further to suppress reporting of the first and second HPD signals to an operating system of a computing device if the determined time period does not exceed the predetermined time delay.

11. A method for filtering hot plug signals, comprising:
- receiving a first hot plug detect (HPD) signal and a second HPD signal from an external display device;
- determining a time period between receiving the first and second HPD signals; and
- filtering the first and second HPD signals based on the determined time period.

12. The method of claim 11, wherein filtering comprises comparing the determined time period to a predetermined time delay.

13. The method of claim 12, wherein the predetermined time delay is associated with an auto detect feature of the external display device.

14. The method of claim 12, further comprising determining the predetermined time delay of the external display device.

15. The method of claim 14, wherein the determining the predetermined time delay is based on specification data for the external display device in an operating system of a computing device to which the external display device is communicatively coupled.

16. The method of claim 14, wherein determining the predetermined time period based on extended display identification data (EDID) provided from the external display device.

17. The method of claim 11, wherein the external display device comprises a plurality of display interface protocol capabilities.

18. The method of claim 11, wherein the filtering is to be enabled by a user via an operating system of a computing device to which the external display device is communicatively coupled.

19. The method of claim 11, wherein filtering comprises:

comparing the determined time period to a predetermined time delay; and associating the HPD signals with a valid hot plug event if the determined time period exceeds the predetermined time delay.

20. The method of claim 19, wherein filtering further comprises suppressing reporting of the first and second HPD signals to an operating system of a computing device if the determined time period does not exceed the predetermined time delay.

21. A non-transitory computer-readable storage medium comprising code to direct a processor to:

receive a first hot plug detect (HPD) signal and a second HPD signal from an external display device;

determine a time period between receiving the first and second HPD signals; and filter the first and second HPD signals based on the determined time period.

22. The non-transitory computer-readable medium of claim 21, wherein the filtering is to compare the determined time period to a predetermined time delay associated with an auto detect feature of the external display device.

23. The non-transitory computer-readable medium of claim 22, wherein the code is to direct the processor to determine the predetermined time delay of the external display device based on:

specification data for the external display device in an operating system of a computing device to which the external display device is communicatively coupled;

extended display identification data (EDID) provided from the external display device; or any combination thereof.

24. The non-transitory computer-readable medium of claim 21, wherein the external display device comprises a plurality of display interface protocol capabilities.

25. The non-transitory computer-readable medium of claim 21, wherein during filtering, the code is to direct the processor to compare the determined time period to a predetermined time delay;

associate the HPD signals with a valid hot plug event if the determined time period exceeds the predetermined time delay; and suppress reporting of the first and second HPD signals to an operating system of a computing device if the determined time period does not exceed the predetermined time delay.

* * * * *